US010258120B2

(12) United States Patent
Crayton

(10) Patent No.: US 10,258,120 B2
(45) Date of Patent: Apr. 16, 2019

(54) MULTIPLE-FOLD FRAME ASSEMBLY

(71) Applicant: Charles E Crayton, Orlando, FL (US)

(72) Inventor: Charles E Crayton, Orlando, FL (US)

( * ) Notice: Subject to any disclaimer, the term of this patent is extended or adjusted under 35 U.S.C. 154(b) by 0 days.

(21) Appl. No.: 15/634,559

(22) Filed: Jun. 27, 2017

(65) Prior Publication Data

US 2018/0368543 A1 Dec. 27, 2018

(51) Int. Cl.
*A45B 19/10* (2006.01)
*A45B 25/02* (2006.01)

(52) U.S. Cl.
CPC ..... *A45B 19/10* (2013.01); *A45B 25/02* (2013.01)

(58) Field of Classification Search
CPC ..... A45B 19/10
USPC ..... 135/25.3, 31
See application file for complete search history.

(56) References Cited

U.S. PATENT DOCUMENTS 2,215,738 A * 9/1940 Kohler ..... A45B 19/12 135/25.2
3,901,257 A 8/1975 Schafer
3,902,514 A 9/1975 Weber
3,989,055 A 11/1976 Saito
4,007,752 A 2/1977 Weber
4,420,007 A 12/1983 Wu
4,627,455 A 12/1986 Okuda et al.
4,676,262 A 6/1987 Yang
4,766,917 A 8/1988 Yang
5,063,953 A * 11/1991 Wu ..... A45B 19/10 135/25.3
5,193,565 A 3/1993 Huang
5,235,998 A 8/1993 Liu
5,337,770 A * 8/1994 Wang ..... A45B 19/10 135/25.3
5,467,792 A * 11/1995 Okuda ..... A45B 19/10 135/25.3
5,472,006 A * 12/1995 Kuo ..... A45B 19/10 135/25.3
5,551,463 A 9/1996 Wang
6,112,755 A 9/2000 Lin et al.
6,164,302 A 12/2000 Ko
6,164,303 A 12/2000 Lin et al.
6,244,284 B1 6/2001 Wang
6,360,759 B1 3/2002 Lin et al.
6,394,115 B1 5/2002 Tsun
6,470,899 B2 10/2002 Johnson et al.
6,497,242 B1 12/2002 Lin et al.
6,588,439 B2 7/2003 Wu
(Continued)

*Primary Examiner* — David R Dunn
*Assistant Examiner* — Danielle Jackson
(74) *Attorney, Agent, or Firm* — Jason T. Daniel, Esq.; Daniel Law Offices, P.A.

(57) ABSTRACT

A foldable frame is disclosed. The foldable frame contains at least one multiple-fold frame assembly containing an inner intermediate stretcher rib containing a first end and a second end, an outer intermediate stretcher rib containing a first end and a second end, and an outer leverage arm containing a first end and a second end, wherein the inner intermediate stretcher rib's second end is pivotally coupled with the outer intermediate stretcher rib's second end, wherein the outer leverage arm's second end is pivotally coupled with the outer intermediate stretcher rib adjacent to the first end, wherein the outer leverage arm's second end is pivotally coupled with the outer intermediate stretcher rib a first distance from the first end.

14 Claims, 6 Drawing Sheets

(56) References Cited

U.S. PATENT DOCUMENTS

| | | | | |
|---|---|---|---|---|
| 6,817,371 | B2 | 11/2004 | Lin et al. | |
| 6,834,659 | B2 | 12/2004 | Liu et al. | |
| 7,174,906 | B2 | 2/2007 | Ko | |
| 8,757,184 | B1 | 6/2014 | Chen et al. | |
| 9,301,582 | B2 | 4/2016 | Haythornthwaite et al. | |
| 2005/0161068 | A1* | 7/2005 | Li | A45B 19/10 135/31 |
| 2006/0107981 | A1* | 5/2006 | Ko | A45B 19/10 135/25.3 |
| 2006/0207639 | A1* | 9/2006 | Ko | A45B 19/10 135/25.3 |
| 2007/0000529 | A1* | 1/2007 | You | A45B 19/10 135/25.3 |

* cited by examiner

MULTIPLE-FOLD FRAME ASSEMBLY

TECHNICAL FIELD

The present invention relates generally to an umbrella, and more particularly to an umbrella with a multiple-fold frame assembly.

BACKGROUND

The statements in this section merely provide background information related to the present disclosure and may not constitute prior art.

Although compact pocket, purse and briefcase-size umbrellas are very popular, they have a very limited radius when in an opened (i.e. extended, deployed) position and therefore do not provide adequate protection from the elements of weather. Conventional size umbrellas or large golf umbrellas on the other hand do provide a large radius in the opened (i.e. extended, deployed) position thereby providing adequate protection from the elements of weather. However, the conventional size umbrellas are cumbersome to carry when not in use and limit the dexterity of its user. The conventional umbrella can make it difficult to negotiate crowded environments such as public transportation and elevators. The conventional umbrellas may also make it difficult to manipulate objects such as doors or retrieve objects that require both hands.

In view of the above, a need exists for a collapsible umbrella frame that offers substantive protection against the elements of weather.

SUMMARY OF THE INVENTION

The present invention is directed to a multiple fold frame assembly for umbrellas. One embodiment of the present invention can include a plurality of individual multiple fold frame assemblies that are slidingly engaged onto an umbrella shaft for transition between an open and closed position.

In the open position, the multiple fold frame assembly can include a coverage area that is complementary to a full size traditional golf umbrella. In the closed position, the multiple fold frame assembly can include a size that is complementary to a small briefcase umbrella.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Moreover, other embodiments are also contemplated wherein the umbrella can be designed to fold in a reverse manner, so as to form a reverse multiple fold umbrella.

Figure 1A:
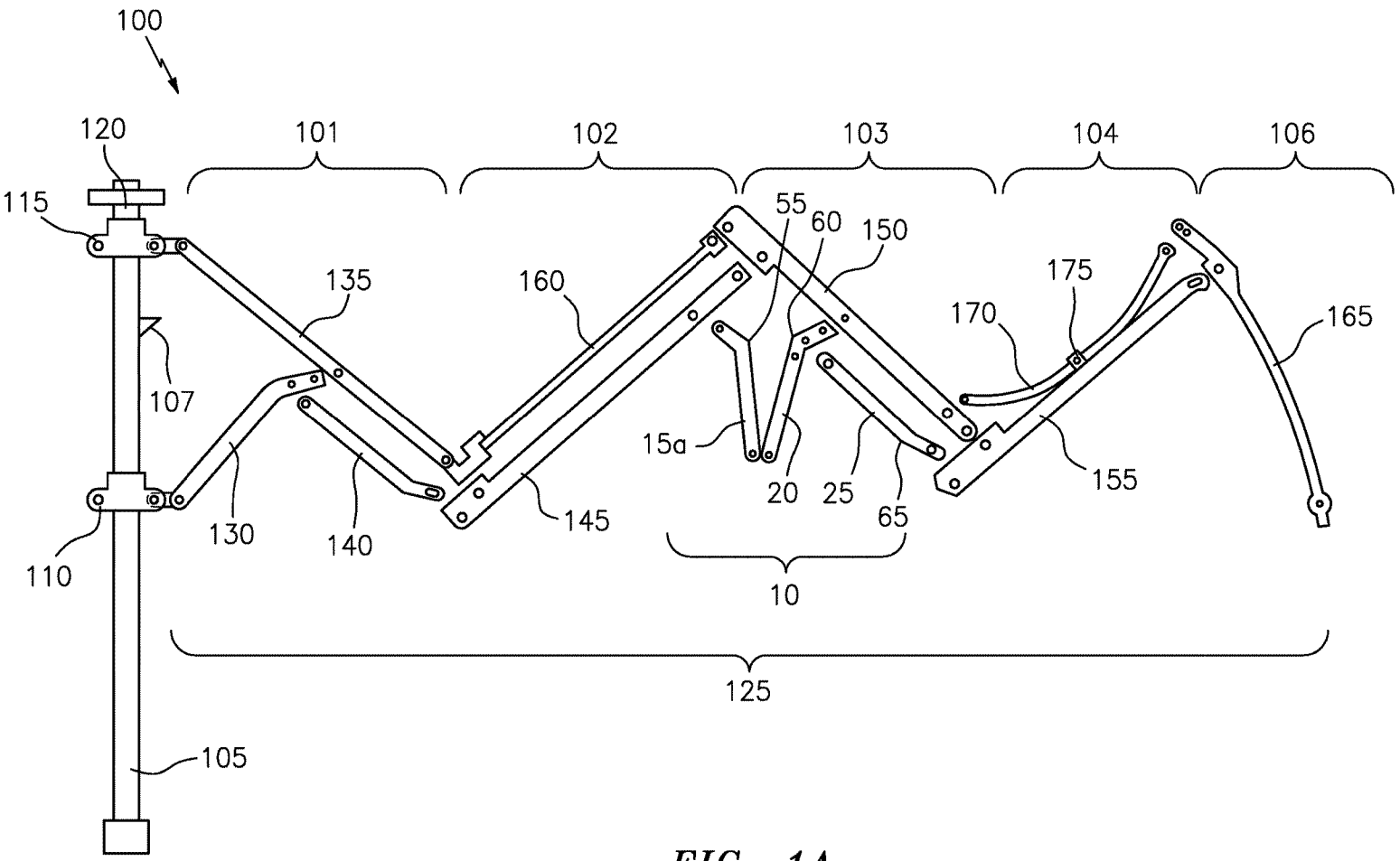
FIG. 1A depicts a folding umbrella with a multiple-fold frame assembly in the extended configuration, according to the present disclosure.
Figure 1B:
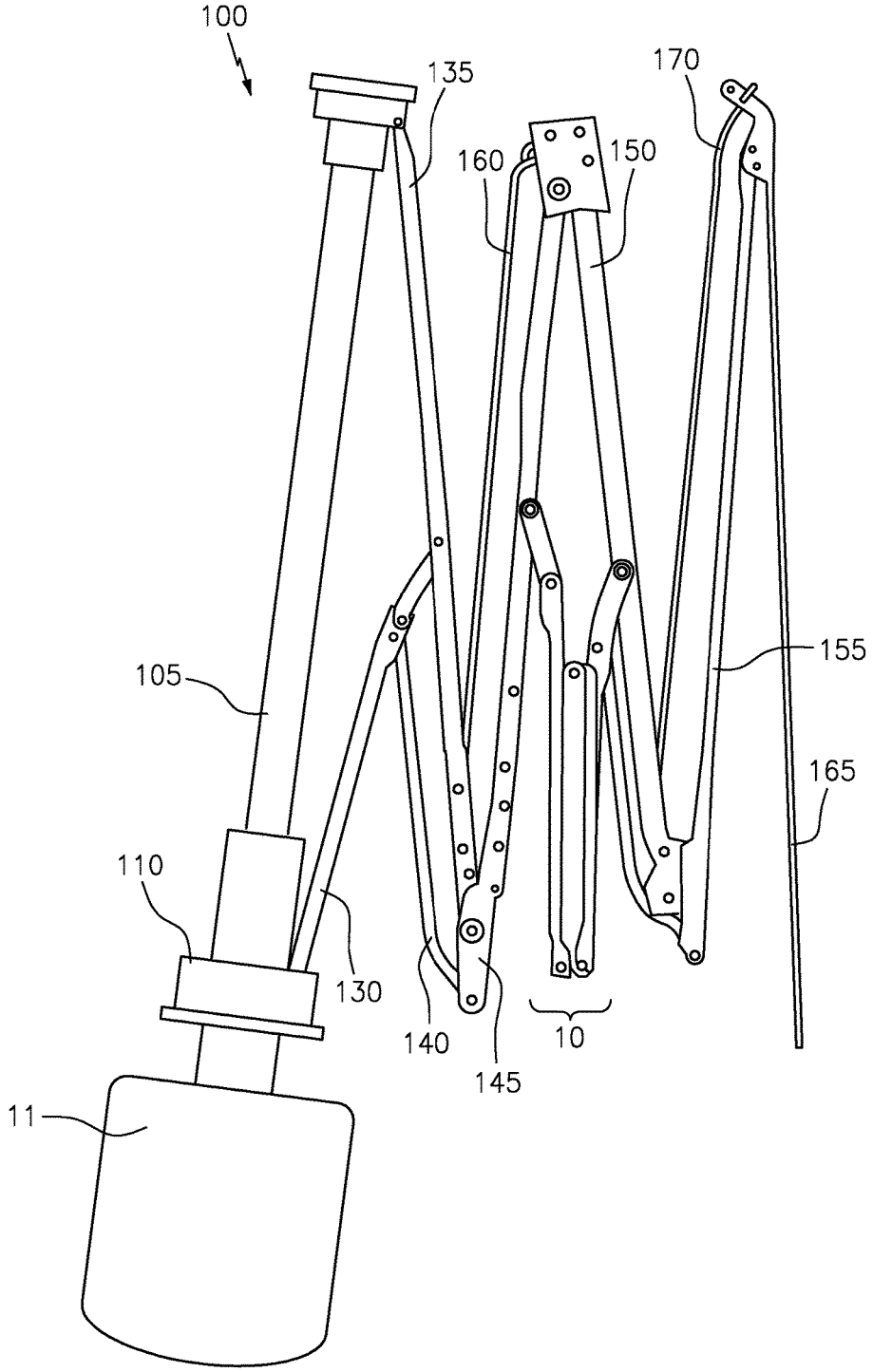
FIG. 1B depicts an umbrella with a multiple-fold frame assembly in the closed configuration, according to the present disclosure.

FIGS. 1A and 1B illustrate one embodiment of an umbrella 100 having a single multiple-fold frame assembly 125 in the extended and closed position, respectively. As will be described below, an assembled umbrella can include a plurality of individual frame assemblies having a waterproof fabric secured thereto, in order to provide the large radius coverage of a full size umbrella in the open position, while also providing the small size of a briefcase umbrella in the closed position. For ease of illustration, only a single frame assembly is illustrated, and the individual features of the frame assembly are shown prior to being interconnected.

As shown, the umbrella 100 can include a handle 11, and an elongated shaft (i.e. post) 105 that can be fixed size or telescoping in nature. The umbrella 100 may comprise a slider support 110 that is slidingly mounted on the shaft 105. The slider support 110 is configured to slide upward and downward along the shaft 105. The umbrella 100 may comprise a fixed support 115 coupled with the top end 120 of the shaft 105. The umbrella 100 may comprise an umbrella cover (i.e. canopy) (not shown) coupled with and covering each of the plurality of individual segment assemblies 125, described below.

The umbrella 100 can include a plurality of segment assemblies 125 pivotally coupled with the slider support 110 and pivotally coupled with the fixed support 115. In one embodiment, each segment assembly 125 may comprise five segments 101, 102, 103, 104, and 106. The shaft 105 may comprise a locking mechanism 107 to hold the segment assembly 125 in the extended (i.e. open) position.

Each segment assembly 125 may comprise a deployment/retraction arm 130 pivotally coupled with the slider support 110 and pivotally coupled with an inner upper construction rib 135 (e.g., a first rib). The inner upper construction rib 135 may also be pivotally coupled with the fixed support 115. Each segment assembly 125 may further comprise an inner leverage arm 140 pivotally coupled with the deployment/retraction arm 130 and pivotally coupled with an inner lower construction rib 145 (e.g., a second rib). The inner upper construction rib 135 may also be pivotally coupled with the inner lower construction rib 145 and pivotally coupled with an inner tension rod 160. The deployment/retraction arm 130, the inner upper construction rib 135, and the inner leverage arm 140 form the segment 101. The inner lower construction rib 145 and the inner tension rod 160 form the segment 102.

The inner tension rod 160 and the inner lower construction rib 145 may both be pivotally coupled with an upper outer construction rib 150 (e.g., a third rib). The upper outer construction rib 150 forms segment 103. The upper outer construction rib 150 may be pivotally coupled with an outer lower construction rib 155 (e.g., a fourth rib) and may be pivotally coupled with an outer tension spring 170. The outer tension spring 170 may also be non-pivotally coupled with the outer lower construction rib 155 using for example retainer/tension device 175. The outer lower construction rib 155 and the outer tension spring 170 form the segment 104.

Segments 102, 103 and 104 may be joined together by an intermediate stretcher support section 10 described in detail below. The intermediate stretcher support section 10 may be pivotally coupled with the inner lower construction rib 145 (e.g., the second rib), the upper outer construction rib 150 (e.g., the third rib), and the outer lower construction rib 155 (e.g., the fourth rib).

Each segment assembly 125 may also comprise an outer extension rod 165 (e.g., a fifth rib) pivotally coupled with the outer tension spring 170 and the outer lower construction rib 155. The outer extension rod 165 forms the segment 106.

Although other dimensions are contemplated, it is preferred that segments 101-104 each include a length of approximately 6 inches from end to end, and that segment 106 include a length of approximately 8 inches from end to end, forming an umbrella radius of 32 inches. Such dimensions, when combined with other segment assemblies 125 having identical dimensions form a diameter of coverage at approximately 64 inches, which is comparable to the size of traditional full size golf umbrellas. However, as each individual segment is either 6 or 8 inches, the umbrella in the collapsed orientation maintains a size that is smaller than the length of the handle 11 and shaft 105, which is approximately 10 inches from end to end, thereby representing the small size of a briefcase umbrella.

Figure 2:
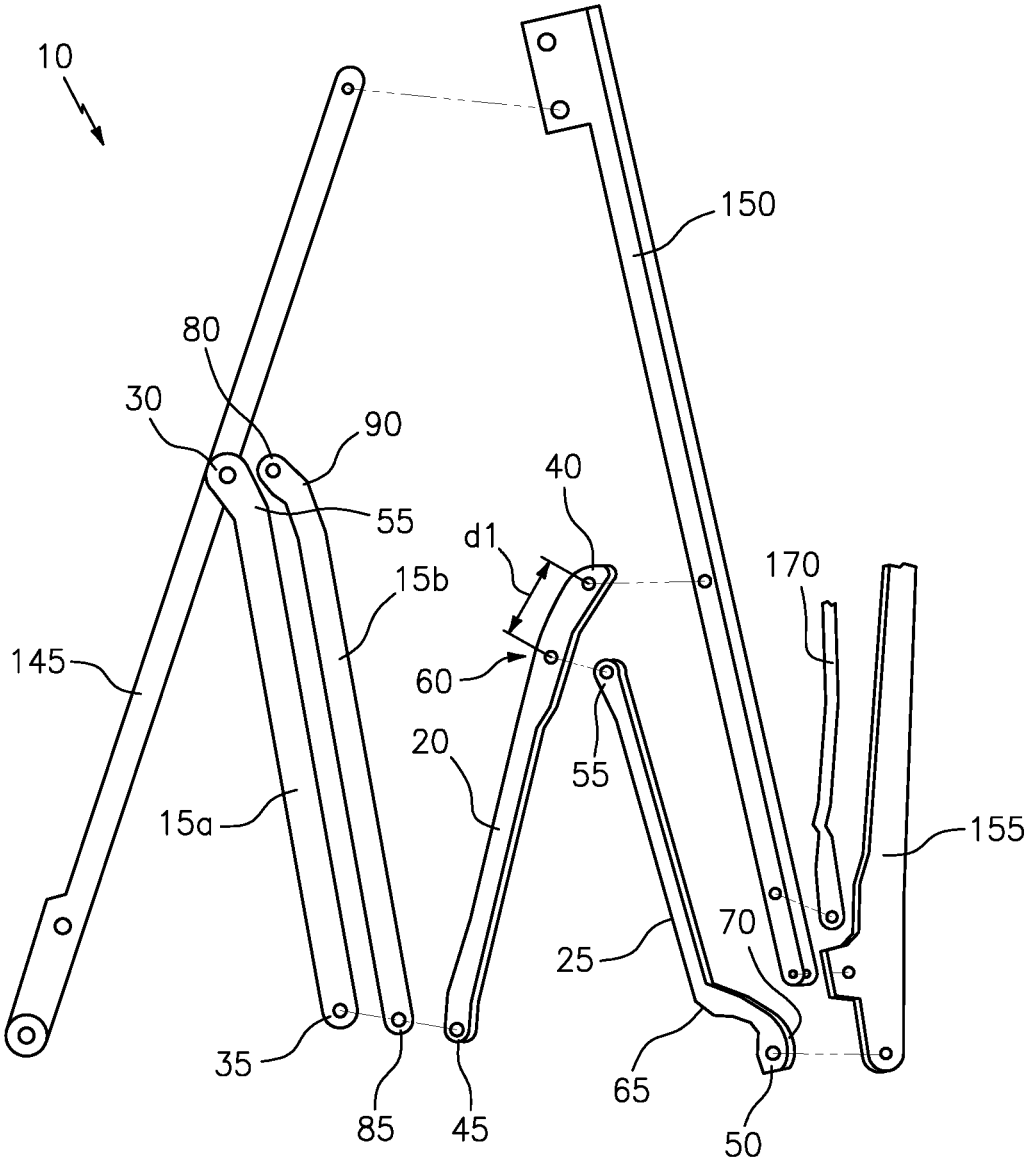
FIG. 2 is a cutout exploded parts view of an intermediate stretcher section of the multiple-fold frame assembly according to the present disclosure.

FIG. 2 is a cutout and exploded parts view of the intermediate stretcher section 10 illustrated in FIG. 1. As shown, the intermediate stretcher section 10 can include an inner intermediate stretcher rib 15*a*, outer intermediate stretcher rib 20 and an outer leverage arm 25. The inner intermediate stretcher rib 15*a* comprises a first end 30 and a second end 35. The outer intermediate stretcher rib 20 comprises a first end 40 and a second end 45. The outer leverage arm 25 comprises a first end 50 and a second end 55.

According to some embodiments, the inner intermediate stretcher rib 15*a*'s second end 35 is pivotally coupled with the outer intermediate stretcher rib 20's second end 45. According to some embodiments, the outer leverage arm 25's second end 55 is pivotally coupled with the outer intermediate stretcher rib 20 adjacent to the first end 40. According to some embodiments, the outer leverage arm 25's second end 55 is pivotally coupled with the outer intermediate stretcher rib 20 a first distance d1 from the first end 40. The first distance is between approximately ¼ and ¾ inches.

The inner intermediate stretcher rib 15*a*'s first end 30 may be bent at 55. The outer intermediate stretcher rib 20's first end 40 may be bent at 60. The outer leverage arm 25's first end 50 may be bent at 65 and 70. The bends 55, 60, 65, and 70 may be varied in length of bent portion, radius, angle, location of bend, etc. to enable the intermediate stretcher section 10 to fold (i.e. close) flat, as will be described below.

The intermediate stretcher section 10 is configured to move from an extended (i.e. opened) position to a folded (i.e. closed) position and back again. According to some embodiments, when the intermediate stretcher section 10 is in the extended position, the inner intermediate stretcher rib 15*a*'s first end 30 is pivoted away from the outer intermediate stretcher rib 20's first end 40. According to some embodiments, when the intermediate stretcher section 10 is in the extended position, the inner intermediate stretcher rib 15*a*'s first end 30 is a second distance away from the outer intermediate stretcher rib 20's first end 40. The second distance is about 6 inches.

According to some embodiments, when the intermediate stretcher section 10 is in the extended position, the outer leverage arm 25's first end 50 is pivoted away from the outer intermediate stretcher rib 20's second end 45. According to some embodiments, when the intermediate stretcher section 10 is in the extended position, the outer leverage arm 25's first end 50 is a third distance away from the outer intermediate stretcher rib 20's second end 45. The third distance is about 5 inches.

According to some embodiments, when the intermediate stretcher section 10 is in the folded position, the inner intermediate stretcher rib 15*a* is positioned adjacent to the outer intermediate stretcher rib 20. According to some embodiments, when the intermediate stretcher section 10 is in the folded position, at least a portion of the inner intermediate stretcher rib 15*a* overlaps at least a portion of the outer intermediate stretcher rib 20.

According to some embodiments, when the intermediate stretcher section 10 is in the folded position, the outer leverage arm 25 is positioned adjacent to the outer intermediate stretcher rib 20. According to some embodiments, when the intermediate stretcher section 10 is in the folded position, at least a portion of the outer leverage arm 25 overlaps as least a portion of the outer intermediate stretcher rib 20.

According to some embodiments, the outer intermediate stretcher rib 20 comprises a recessed cavity (not shown)

configured to accommodate at least a portion of the outer leverage arm 25 when the intermediate stretcher section 10 is in the folded position. As shown, the intermediate stretcher section 10 may be pivotally coupled with the lower construction rib 145 of segment 102, and the outer upper construction rib 150 of segment 103 in a generally inverse orientation to the ribs 145 and 150 as shown in FIG. 1A.

According to some embodiments, the intermediate stretcher section 10 may further comprise an inner intermediate stretcher rib 15*b*. The inner intermediate stretcher rib 15*b* comprises a first end 80 and a second end 85. The inner intermediate stretcher rib 15*b*'s second end 85 may be pivotally coupled with the outer intermediate stretcher rib 20's second end 45. The inner intermediate stretcher rib 15*b*'s first end 80 may be pivotally coupled with the first segment 145 of the foldable frame. The inner intermediate stretcher rib 15*b* may be positioned parallel to and adjacent to the inner intermediate stretcher rib 15*a*.

The inner intermediate stretcher rib 15*b*'s first end 80 may be bent at 90. The bend 90 may be varied in length of bent portion, radius, angle, location of bend, etc. to enable the intermediate stretcher section 10 to fold (i.e. close) flat.

According to some embodiments, when the intermediate stretcher section 10 is in the extended position, the inner intermediate stretcher rib 15*b*'s first end 80 is pivoted away from the outer intermediate stretcher rib 20's first end 40. According to some embodiments, when the intermediate stretcher section 10 is in the extended position, the inner intermediate stretcher rib 15*b*'s first end 80 is a second distance away from the outer intermediate stretcher rib 20's first end 40. The second distance is about 6 inches.

According to some embodiments, when the intermediate stretcher section 10 is in the folded position, the inner intermediate stretcher rib 15*b* is positioned adjacent to the outer intermediate stretcher rib 20. According to some embodiments, when the intermediate stretcher section 10 is in the folded position, at least a portion of the inner intermediate stretcher rib 15*b* overlaps at least a portion of the outer intermediate stretcher rib 20. According to some embodiments, when the intermediate stretcher section 10 is in the folded position, at least a portion of the outer intermediate stretcher rib 20 is positioned between the inner intermediate stretcher ribs 15*a* and 15*b*.

Figure 3:
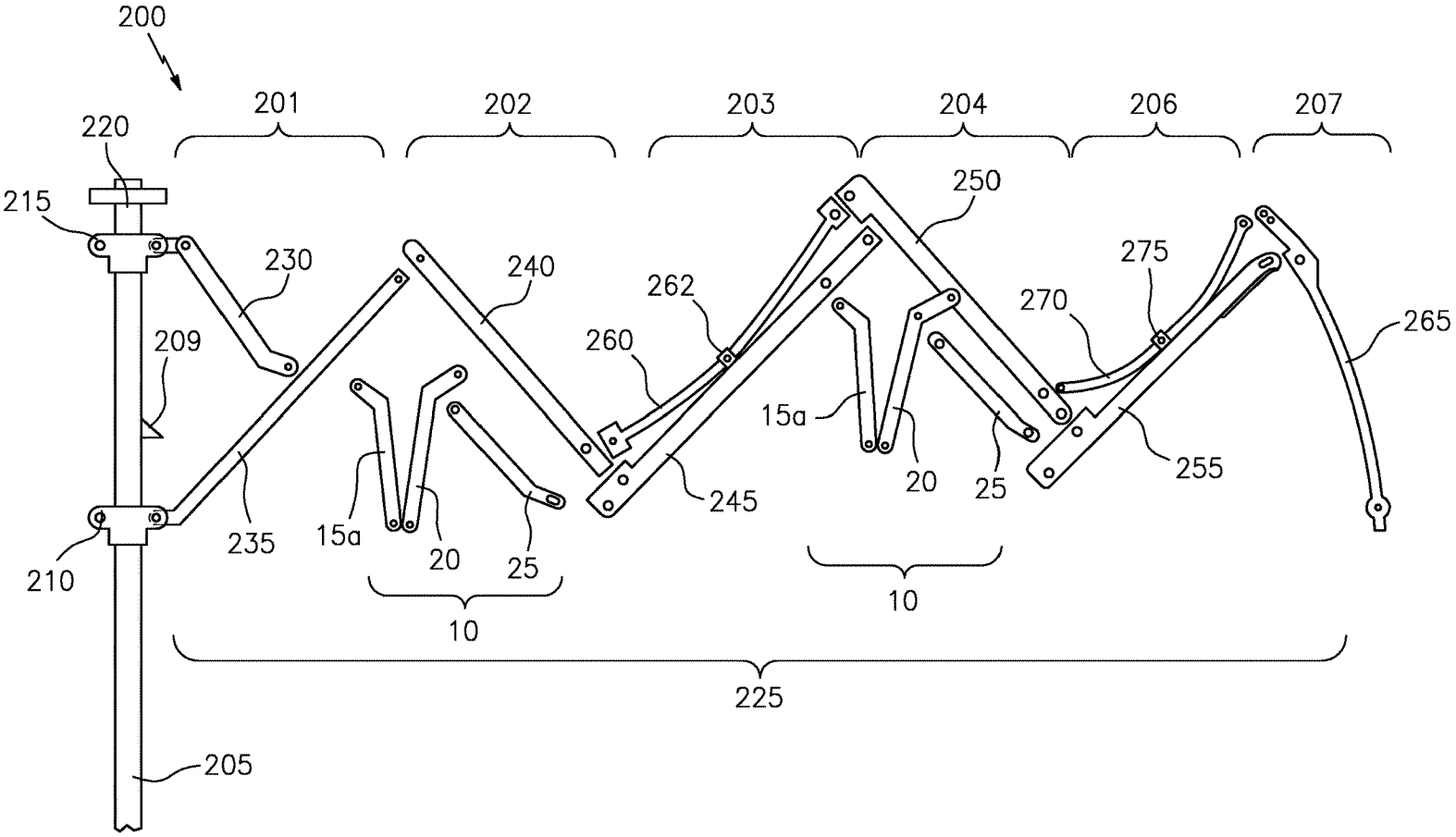
FIG. 3 depicts another folding umbrella with the multiple-fold frame assembly according to the present disclosure.

FIG. 3 depicts a partially collapsed general skeleton for a folding umbrella 200 according to some embodiments presently disclosed. Individual features of the folding umbrella 200 in FIG. 3 are shown prior to being interconnected.

The folding umbrella 200 may comprise a shaft (i.e. post) 205. The shaft 205 may be fixed size or telescoping. The folding umbrella 200 may comprise a slider support 210 slidably mounted on the shaft 205. The slider support 210 is configured to slide upward and downward along the shaft 205. The folding umbrella 200 may comprise a fixed support 215 coupled with the top end 220 of the shaft 205. The folding umbrella 200 may comprise an umbrella cover (i.e. canopy) (not shown) coupled with and covering segments 201, 202, 203, 204, 206 and 207 of the umbrella 200 as described below.

According to some embodiments, the folding umbrella 200 comprises a plurality of segment assemblies 225 pivotally coupled with the slider support 210 and pivotally coupled with the fixed support 215. Each segment assembly 225 may comprise six segments 201, 202, 203, 204, 206 and 207. The shaft 205 may comprise a locking mechanism 209 to hold the segment assembly 225 in the extended (i.e. open) position.

Each segment assembly 225 may comprise a deployment/retraction arm 230 pivotally coupled with the fixed support 215 and pivotally coupled with a construction rib 235 (e.g., a first rib). The construction rib 235 may also be pivotally coupled with the slider support 210. The deployment/retraction arm 230 and the construction rib 235 form segment 201.

The construction rib 235 may also be pivotally coupled with a construction rib 240 (e.g., a second rib). The construction rib 240 forms segment 202. The construction rib 240 may be pivotally coupled with an outer lower construction rib 245 (e.g., a third rib) and pivotally coupled with an outer tension spring 260. The outer tension spring 260 may also be non-pivotally coupled with the outer lower construction rib 245 using for example retainer/tension device 262. The outer lower construction rib 245 and the outer tension spring 260 form segment 203.

The segments 201, 202 and 203 may be joined together by a first intermediate stretcher section 10 described in detail above. The first intermediate stretcher section 10 may be pivotally coupled with the construction rib 235, the construction rib 240, and the outer lower construction rib 245.

Each segment assembly 225 may further comprise an upper outer construction rib 250 (e.g., a fourth rib) pivotally coupled with the outer lower construction rib 245 and the outer tension spring 260. The upper outer construction rib 250 forms segment 204. The upper outer construction rib 250 may be pivotally coupled with an outer lower construction rib 255 (e.g., a fifth rib) and pivotally coupled with an outer tension spring 270. The outer tension spring 270 may also be non-pivotally coupled with the outer lower construction rib 255 using for example retainer/tension device 275. The outer lower construction rib 255 and the outer tension spring 270 form segment 206.

The segments 203, 204 and 206 may be joined together by a second intermediate stretcher section 10 described in detail above. The second intermediate stretcher section 10 may be pivotally coupled with the outer lower construction rib 245, upper outer construction rib 250, and the outer lower construction rib 255.

Each segment assembly 225 may also comprise an outer extension rod 265 (e.g., a sixth rib) pivotally coupled with the outer tension spring 270 and the outer lower construction rib 255. The outer extension rod 265 forms the segment 207.

Figure 4:
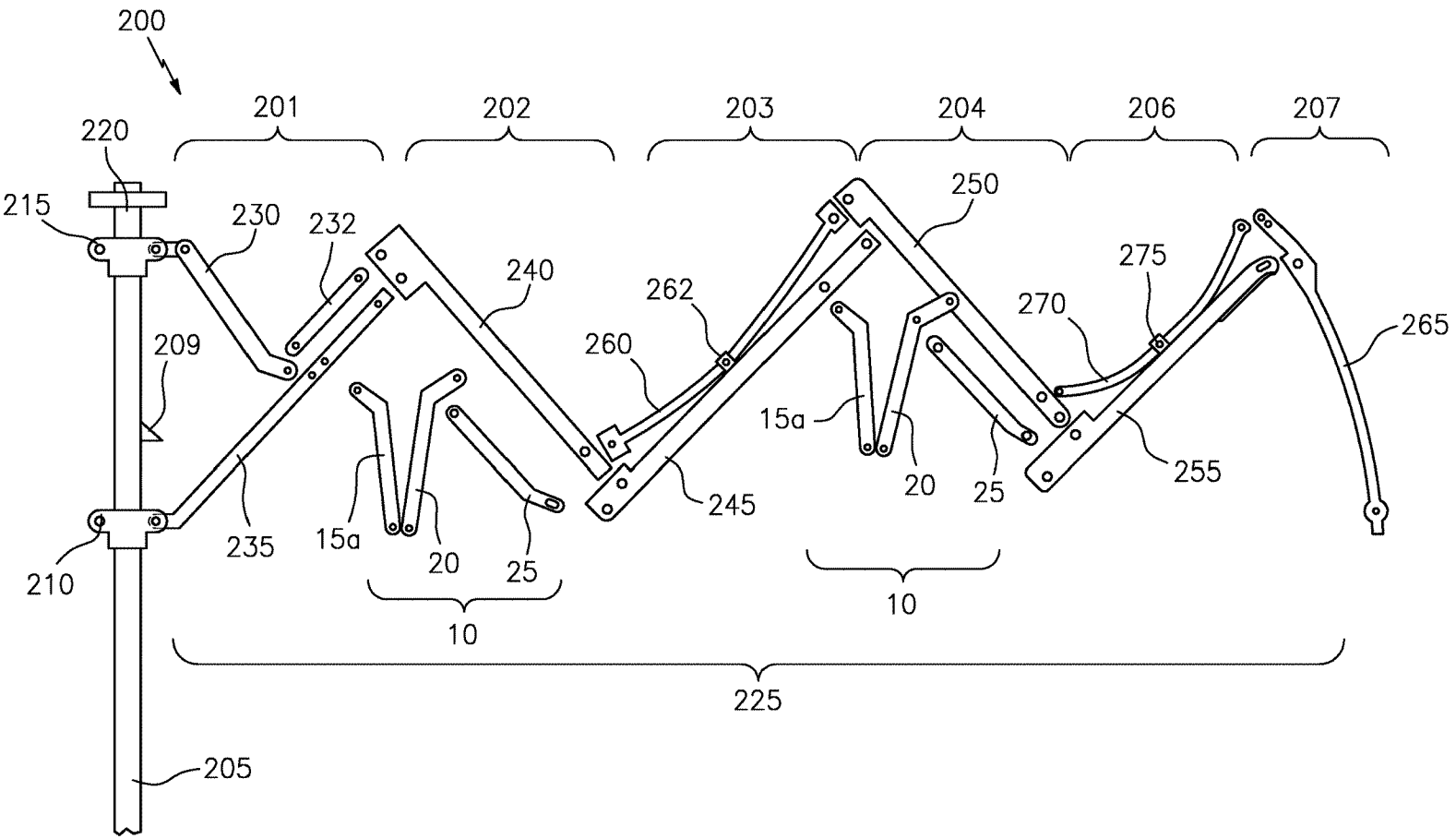
FIG. 4 depicts another folding umbrella with the multiple-fold frame assembly according to the present disclosure.

According to some embodiments, segment 201 may further comprise an inner leverage arm 232 pivotally coupled with the deployment/retraction arm 230 and pivotally coupled with the construction rib 240 as shown in FIG. 4.

Although other dimensions are contemplated, it is preferred that segments 201-206 each include a length of approximately 6 inches from end to end, and that segment 207 include a length of approximately 8 inches from end to end, forming an umbrella radius of 37 inches. Such dimensions, when combined with other segment assemblies 225 having identical dimensions form a diameter of coverage at approximately 74 inches, which is comparable to the size of traditional full size golf umbrellas. However, as each individual segment is either 6 or 8 inches, the umbrella in the collapsed orientation maintains the small size of a briefcase umbrella.

Figure 5:
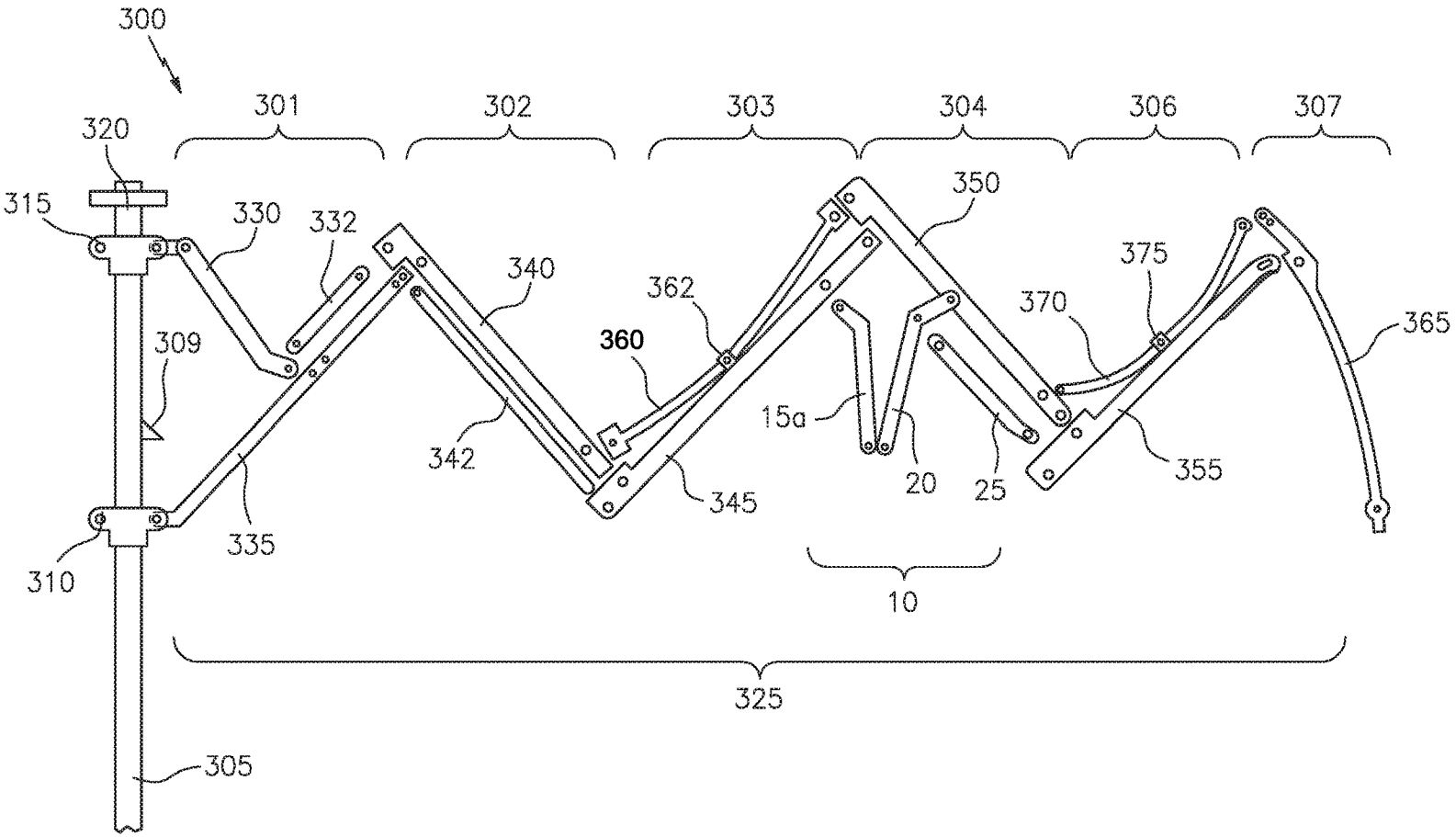
FIG. 5 depicts another folding umbrella with the multiple-fold frame assembly according to the present disclosure.

FIG. 5 depicts a partially collapsed general skeleton for a folding umbrella 300 according to some embodiments presently disclosed. Individual features of the folding umbrella 300 in FIG. 5 are shown prior to being interconnected.

The folding umbrella 300 may comprise a shaft (i.e. post) 305. The shaft 305 may be fixed size or telescoping. The folding umbrella 300 may comprise a slider support 310 slidably mounted on the shaft 305. The slider support 310 is configured to slide upward and downward along the shaft 305. The folding umbrella 300 may comprise a fixed support 315 coupled with the top end 320 of the shaft 305. The folding umbrella 300 may comprise an umbrella cover (i.e. canopy) (not shown) coupled with and covering segments 301, 302, 303, 304, 306 and 307 of the umbrella 300 as described below.

According to some embodiments, the folding umbrella 300 comprises a plurality of segment assemblies 325 pivotally coupled with the slider support 310 and pivotally coupled with the fixed support 315. Each segment assembly 325 may comprise six segments 301, 302, 303, 304, 306 and 307. The shaft 305 may comprise a locking mechanism 309 to hold the segment assembly 325 in the extended (i.e. open) position.

Each segment assembly 325 may comprise a deployment/retraction arm 330 pivotally coupled with the fixed support 315 and pivotally coupled with a construction rib 335. Each segment assembly 325 may comprise an inner leverage arm 332 pivotally coupled with the deployment/retraction arm 330 and pivotally coupled with a construction rib 340. The construction rib 335 may also be pivotally coupled with the slider support 310. The deployment/retraction arm 330, the inner leverage arm 332, and the construction rib 335 form segment 301. The construction rib 335 may also be pivotally coupled with the construction rib 340 and a construction rib 342. The construction ribs 340 and 342 form segment 302.

Each segment assembly 325 may comprise an outer lower construction rib 345 pivotally coupled with the construction ribs 340 and 342. Each segment assembly 325 may also comprise an outer tension spring [260] 360 pivotally coupled with the construction rib 340. The outer tension spring 360 may also be non-pivotally coupled with the outer lower construction rib 345 using for example retainer/tension device 362. The outer lower construction rib 345 and the outer tension spring 360 form segment 303.

Each segment assembly 325 may further comprise an upper outer construction rib 350 pivotally coupled with the outer lower construction rib 345 and the outer tension spring 360. The upper outer construction rib 350 forms segment 304. The upper outer construction rib 350 may be pivotally coupled with an outer lower construction rib 355 and pivotally coupled with an outer tension spring 370. The outer tension spring 370 may also be non-pivotally coupled with the outer lower construction rib 355 using for example retainer/tension device 375. The outer lower construction rib 355 and the outer tension spring 370 form segment 306.

The segments 303, 304 and 306 may be joined together by the intermediate stretcher section 10 described in detail above. The intermediate stretcher section 10 may be pivotally coupled with the outer lower construction rib 345, upper outer construction rib 350, and the outer lower construction rib 355.

Each segment assembly 325 may also comprise an outer extension rod 365 pivotally coupled with the outer tension spring 370 and the outer lower construction rib 355. The outer extension rod 365 forms the segment 307.

The pivoting interconnects as described above may be connected by the use of rivets, screws or other means which allow for pivoting of connections. The none-pivoting interconnect may be connected via welds, clips, crimps, rivets, screws or any other means which allow for deployment and retraction of a frame.

The segment assemblies 125, 225, 325 of the folding umbrellas 100, 200, 300 respectfully may move from a folded (i.e. closed) position to an extended (i.e. opened) position and back again either manually by a user or automatically by push of a button. As the segment assemblies 125, 225, 325 moves from the folded (i.e. closed) position to the extended (i.e. open) position, the corresponding intermediate stretcher section 10 also moves from the folded (i.e. closed) position to the extended (i.e. open) position. As the segment assemblies 125, 225, 325 moves from the extended (i.e. open) position to the folded (i.e. closed) position, the corresponding intermediate stretcher section 10 also moves from the extended (i.e. open) position to the folded (i.e. closed) position.

The segment assembly 125 may be moved from a folded (i.e. closed) position to an extended (i.e. open) position by applying an opening force to the slider support 110 toward the fixed support 115 along the post 105.

The opening force being applied to the slider support 110 should be sufficient enough to cause an outward force to be distributed to the deployment/retraction arm 130. The outward force is then distributed outward along the inner upper constructions rib 135 with an inward pull on the inner leverage arm 140. The deployment/retraction arm 130 further distributes the outward force outward to the inner lower construction rib 145 and inward pull to an inner tension rod 160. In turn, this causes an inward pull to an inner tension rod 160 with an inward pull to an inner lower construction rib 145. The forces on an inner lower construction rib 145 and an inner tension rod 160 results in an inward pull on the inner intermediate stretcher rib 15*a*, the outer intermediate stretcher rib 20 and the outer leveraging arm 25.

The inner tension rod 160 causes an inward pull to the upper outer construction rib 150. The outer leveraging arm 25 applies an inward force to the outer lower construction rib 155. The upper outer construction rib 150 applies an inward force to the outer tension spring 170 through the retainer/tension device 175 to the outer extension rod 165. The outer leveraging arm 25 further causes an inward force on the outer lower constructions rib 155. The outer tension spring 170 also causes an inward force on an outer extension rod 165. The outer lower constructions rib 155 caused an outward force on the outer extension rod 165. The overall result is the extension of the segment assembly 125 and its canopy (not shown). The shaft 105 may comprise the locking mechanism 107 to hold the segment assembly 125 in the extended (i.e. open) position.

It is to be understood that similar reactions may be caused when moving segment assembly 225 and/or 325 from a folded (i.e. closed) position to an extended (i.e. open).

The segment assembly 125 may be moved from an extended (i.e. open) position to a folded (i.e. closed) position by disengaging the locking mechanism 107 that holds the segment assembly 125 in the extended (i.e. open) position and applying closing force by pulling the slider support 110 away from the fixed support 115 along the post 105.

The closing force being applied to the slider support 110 should be sufficient enough to cause an inward force to be distributed to the deployment/retraction arm 130. The inward force is then distributed inward along inner upper constructions rib 135 with an inward pull on the inner leverage arm 140. The deployment/retraction arm 130 further distributes inward force outward to the inner lower construction rib 145 and an inward pull to the inner tension rod 160. The forces on the inner lower construction rib 145 and the inner tension rod 160 result in an outward push on the inner intermediate stretcher rib 15*a*, an inward pull on the outer intermediate stretcher rib 20 and an outward push on the outer leveraging arm 25.

The inner tension rod 160 causes and an outward push to the upper outer construction rib 150. The outer leveraging arm 25 applies an outward force to outer lower construction rib 155. The upper outer construction rib 150 applies an inward force through the retainer/tension device 175 to the outer tension spring 170. The outer tension spring 170 causes an outward force on the outer extension rod 165. The outer lower constructions rib 155 causes and provides a stabilizing force on the outer extension rod 165. The overall result is the retraction (i.e. closure) of the segment assembly 125 and its canopy (not shown).

It is to be understood that similar reactions may be caused when moving segment assembly 225 and/or 325 from an extended (i.e. open) to a folded (i.e. closed) position.

It is also to be understood that other automatic deployment and retraction mechanism or other schemes may also be used to apply sufficient force for deployment (i.e. opening) and retraction (i.e. closure) of the segment assemblies 125, 225, and/or 325.

As shown above, one or more multiple-fold frame assemblies 10 may be used to manufacture a folding umbrella having two, three, four, five or more segments thereby increasing the radius of the folding umbrella when it is in the open position. Increasing the radius on the folding umbrella provides greater protection from weather while remaining very portable. The folding umbrellas utilizing one or more multiple-fold frame assemblies 10 can be carried in a pocket, a purse or briefcase or other small areas.

The folding umbrellas utilizing one or more multiple-fold frame assemblies 10 can be manufactured to be opened and closed manually or via any automatic opening and closing mechanism known in the art. The folding umbrellas utilizing one or more multiple-fold frame assemblies 10 can be designed using various anti-inversion mechanisms known in the art.

The folding umbrellas utilizing one or more multiple-fold frame assemblies 10 can be designed with segments and/or ribs of various lengths to produce folding umbrellas of various arc lengths, diameters and circumferences of protection from weather elements. The folding umbrellas utilizing one or more multiple-fold frame assemblies 10 can be manufactured with strength enough to support a canopy made of nylon, cotton, plastic and/or any combination of these materials.

The folding umbrellas utilizing one or more multiple-fold frame assemblies 10 can be designed and manufactured with rods, beams or shafts to build the frame. The ribs, rods, beams or shafts can be solid, u-shaped or hollow tube. The ribs, rods, beam or shafts may be solid, u-shaped or square bent the same as any of the present designs or any variation thereof.

The folding umbrellas utilizing one or more multiple-fold frame assemblies 10 provides an inexpensive means for the manufacture of more portable multiple fold mini-umbrellas, standard umbrellas, golf umbrellas, beach umbrellas, patio umbrellas and market umbrellas.

The one or more multiple-fold frame assemblies 10 presently disclosed can be used to manufacture conventional and/or wind resistant folding umbrellas.

The one or more multiple-fold frame assemblies 10 presently disclosed can be used to manufacture folding umbrellas of various shapes and sizes such as circular, flat, oval, rectangular and square.

The folding umbrellas utilizing one or more multiple-fold frame assemblies 10 can manufactured using any of the material such as titanium, aluminum, steel, brass or any other type material sufficient to support a canopy.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

Although above embodiments depict the intermediate stretcher section 10 as being part of an umbrella frame, it is to be understood that the intermediate stretcher section 10 according to the present disclosure may be utilized in other frames requiring to be folded flat when in a closed position. For example, the intermediate stretcher section 10 according to the present disclosure may be used as part of a foldable antenna array, foldable solar panel array, or any other array capable of being folded.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A foldable umbrella frame comprising:

at least one five-fold frame assembly that includes a first rib comprising a first end that is configured to engage an umbrella post, and a second end;

a second rib comprising a first end that is pivotally secured to the second end of the first rib, a middle section and a second end;

a third rib comprising a first end that is pivotally secured to the second end of the second rib, a middle section and a second end;

a fourth rib comprising a first end that is pivotally secured to the second end of the third rib, and a second end;

a fifth rib comprising a first end that is pivotally secured to the second end of the fourth rib, and a second end; and an intermediate stretcher support section that is in communication with the middle section of each of the second rib and the third rib, said intermediate stretcher section including an orientation that is generally inverse to an orientation of the second rib and the third rib.

2. The foldable umbrella frame of claim 1, wherein the at least one five-fold frame assembly is configured to move from an extended position to a folded position and back again.

3. The foldable umbrella frame of claim 2, wherein the at least one five-fold frame assembly includes a total length of 32 inches in the extended position.

4. The foldable umbrella frame of claim 1, wherein each of the first rib, the second rib, the third rib and the fourth rib include an identical length.

5. The foldable umbrella frame of claim 4, wherein the fifth rib includes a length that is different from the length of each of the first rib, the second rib, the third rib and the fourth rib.

6. The foldable umbrella frame of claim 1, wherein the at least one five-fold frame assembly includes a plurality of five-fold frame assemblies each configured to move from an extended position to a folded position and back again.

7. The foldable umbrella frame of claim 6, wherein each of the plurality of five-fold frame assemblies includes a length of 32 inches in the extended position.

8. A foldable umbrella frame comprising:

at least one six-fold frame assembly that includes a first rib comprising a first end that is configured to engage an umbrella post, a middle section and a second end;

a second rib comprising a first end that is pivotally secured to the second end of the first rib, a middle section and a second end;

a third rib comprising a first end that is pivotally secured to the second end of the second rib, a middle section and a second end;

a fourth rib comprising a first end that is pivotally secured to the second end of the third rib, a middle section and a second end;

a fifth rib comprising a first end that is pivotally secured to the second end of the fourth rib, and a second end;

a sixth rib comprising a first end that is pivotally secured to the second end of the fifth rib, and a second end;

a first intermediate stretcher support section that is in communication with the middle section of each of the first rib and the second rib, said first intermediate stretcher section including an orientation that is generally inverse to an orientation of the first rib and the second rib; and a second intermediate stretcher support section that is in communication with the middle section of each of the third rib and the fourth rib, said second intermediate stretcher section including an orientation that is generally inverse to an orientation of the third rib and the fourth rib.

9. The foldable umbrella frame of claim 8, wherein the at least one six-fold frame assembly is configured to move from an extended position to a folded position and back again.

10. The foldable umbrella frame of claim 9, wherein the at least one six-fold frame assembly includes a total length of 37 inches in the extended position.

11. The foldable umbrella frame of claim 8, wherein each of the first rib, the second rib, the third rib, the fourth rib and the fifth rib include an identical length.

12. The foldable umbrella frame of claim 11, wherein the sixth rib includes a length that is different from the length of each of the first rib, the second rib, the third rib, the fourth rib and the fifth rib.

13. The foldable umbrella frame of claim 8, wherein the at least one six-fold frame assembly includes a plurality of six-fold frame assemblies each configured to move from an extended position to a folded position and back again.

14. The foldable umbrella frame of claim 13, wherein each of the plurality of five-fold frame assemblies includes a length of 37 inches in the extended position.

* * * * *